US011406213B2

(12) United States Patent
Goelst

(10) Patent No.: US 11,406,213 B2
(45) Date of Patent: Aug. 9, 2022

(54) RETROFIT CURTAIN ASSEMBLY

(71) Applicant: KleenEdge, LLC, Seattle, WA (US)

(72) Inventor: Karen Goelst, Seattle, WA (US)

(73) Assignee: KLEENEDGE, LLC, Seattle, WA (US)

( * ) Notice: Subject to any disclaimer, the term of this patent is extended or adjusted under 35 U.S.C. 154(b) by 0 days.

(21) Appl. No.: 17/186,200

(22) Filed: Feb. 26, 2021

(65) Prior Publication Data

US 2021/0177184 A1 Jun. 17, 2021

Related U.S. Application Data

(63) Continuation of application No. 16/001,845, filed on Jun. 6, 2018, now Pat. No. 10,966,558, which is a (Continued)

(51) Int. Cl.

| | |
|---|---|
| ***A47H 1/14*** | (2006.01) |
| ***A47H 1/04*** | (2006.01) |
| ***A47H 21/00*** | (2006.01) |
| ***A47H 13/01*** | (2006.01) |
| ***A47H 23/08*** | (2006.01) |
| *A47H 15/00* | (2006.01) |

(52) U.S. Cl.

CPC ..... *A47H 1/04* (2013.01); *A47H 1/14* (2013.01); *A47H 13/01* (2013.01); *A47H 21/00* (2013.01); *A47H 23/08* (2013.01); *A47H 2015/005* (2013.01); *A47H 2201/02* (2013.01)

(58) Field of Classification Search

CPC ... A47H 1/04; A47H 1/06; A47H 1/10; A47H 1/104; A47H 1/14; A47H 1/144; A47H 2001/045; A47H 21/00; A47H 2015/005

See application file for complete search history.

(56) References Cited

U.S. PATENT DOCUMENTS

| | | | |
|---|---|---|---|
| 2,064,470 | A | 12/1936 | Heckman |
| 2,264,642 | A | 12/1941 | Rowe |

(Continued)

FOREIGN PATENT DOCUMENTS

| | | |
|---|---|---|
| AT | 294353 | 11/1971 |
| AT | 306280 | 4/1973 |

(Continued)

OTHER PUBLICATIONS

USPTO; Office Action Restriction Requirement dated May 19, 2020 in U.S. Appl. No. 16/001,845.

(Continued)

*Primary Examiner* — Johnnie A. Shablack

(74) *Attorney, Agent, or Firm* — Snell & Wilmer L.L.P.

(57) ABSTRACT

A curtain assembly for hanging a shortened, lighter curtain from existing curtain ceiling tracks. The assembly uses adjustable height hangers to connect the commercially available track to existing curtain systems and a lightweight disposable curtain to hang therefrom. The brackets to attach the track to the room walls and one bracket allows for the vertical insertion of the curtain hooks onto the track. A quick load bracket gathers the curtain hooks for vertical installation through the brackets. The curtain can be installed simply and quickly by one person without a ladder.

17 Claims, 22 Drawing Sheets

Related U.S. Application Data continuation-in-part of application No. 15/253,207, filed on Aug. 31, 2016, now abandoned.

(60) Provisional application No. 62/578,762, filed on Dec. 4, 2017.

(56) References Cited

U.S. PATENT DOCUMENTS

| | | | | |
|---|---|---|---|---|
| 2,412,910 | A | 12/1946 | Rowe | |
| 3,331,095 | A | 7/1967 | Hachtel | |
| 3,396,834 | A | 8/1968 | Luckey | |
| 3,453,682 | A * | 7/1969 | Salzmann | A47H 1/102 16/87.4 R |
| 3,464,364 | A * | 9/1969 | Dehne | B61B 10/025 104/178 |
| 3,587,131 | A * | 6/1971 | Graf | A47H 13/00 16/95 D |
| 3,600,741 | A | 8/1971 | Bays | |
| 3,685,662 | A | 8/1972 | Varon | |
| 3,823,439 | A | 7/1974 | Selset | |
| 3,881,219 | A * | 5/1975 | Haarer | A47H 1/04 16/96 D |
| 3,913,204 | A | 10/1975 | Finkbeiner | |
| 4,126,921 | A | 11/1978 | Pape | |
| 4,153,969 | A | 5/1979 | Mergenthaler | |
| 4,336,757 | A | 6/1982 | Toder | |
| 4,569,164 | A | 2/1986 | Dickson | |
| 5,022,454 | A | 6/1991 | Kobayashi | |
| 5,033,394 | A * | 7/1991 | Summa | B61B 10/04 104/106 |
| 5,329,857 | A | 7/1994 | Owens | |
| 5,425,409 | A | 6/1995 | Guia | |
| 5,513,419 | A | 5/1996 | Zinger | |
| 5,518,058 | A | 5/1996 | Gastmann | |
| 5,659,926 | A | 8/1997 | Dietrich | |
| 6,047,761 | A | 4/2000 | Jaehnen | |
| 7,059,379 | B2 | 6/2006 | Lewis, Jr | |
| 7,128,123 | B2 | 10/2006 | Mullet | |
| 7,861,762 | B2 | 1/2011 | Meichtry | |
| 8,528,622 | B2 | 9/2013 | Ehrlich | |
| 10,231,563 | B2 | 3/2019 | Colacecchi | |
| 10,258,183 | B2 | 4/2019 | Zsarik | |
| 10,966,558 | B2 * | 4/2021 | Goelst | A47H 23/08 |
| 2013/0312333 | A1 | 11/2013 | Liao | |
| 2014/0208545 | A1 | 7/2014 | Jang | |
| 2019/0316399 | A1 | 10/2019 | Sauve | |
| 2020/0109585 | A1 | 4/2020 | Lee | |

FOREIGN PATENT DOCUMENTS

| | | |
|---|---|---|
| AT | 364701 | 11/1981 |
| AT | 408714 | 2/2002 |
| DE | 2062836 | 7/1972 |
| DE | 2213344 | 1/1973 |
| DE | 2141911 | 3/1973 |
| DE | 2947255 | 6/1981 |
| DE | 3039942 | 5/1982 |
| DE | 3233738 | 3/1984 |
| DE | 3315218 | 10/1984 |
| DE | 3607807 | 9/1986 |
| DE | 4334717 | 11/1995 |
| DE | 29604182 | 5/1996 |
| DE | 20000078 | 4/2000 |
| DE | 4410805 | 10/2005 |
| DE | 102005005857 | 8/2007 |
| DE | 102013111085 | 4/2015 |
| EP | 0601306 | 1/1997 |
| GB | 489851 | 7/1938 |
| GB | 1235271 | 6/1971 |
| GB | 2215987 | 10/1989 |
| GB | 2334432 | 8/1999 |

OTHER PUBLICATIONS

USPTO; Non-Final Office Action dated Jun. 15, 2020 in U.S. Appl. No. 16/001,845.

USPTO; Final Office Action dated Dec. 30, 2020 in U.S. Appl. No. 16/001,845.

USPTO; Notice of Allowance dated Jan. 22, 2021 in U.S. Appl. No. 16/001,845.

* cited by examiner

FIG 18
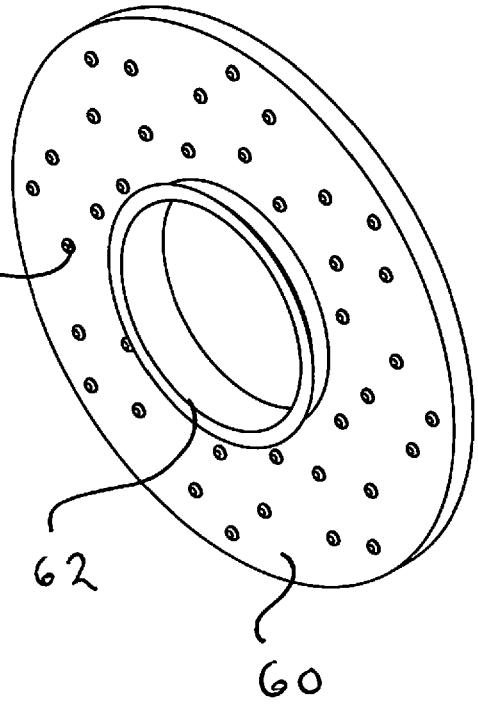
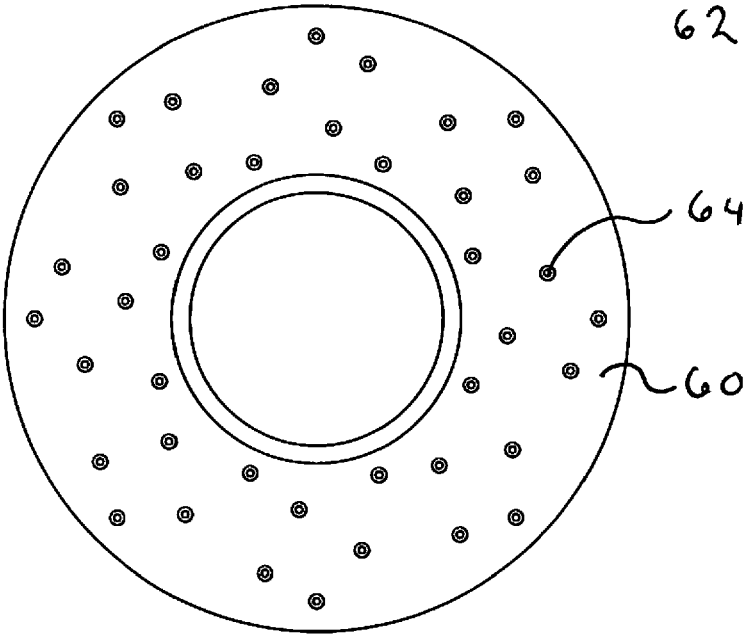
FIG 17

FIG 20
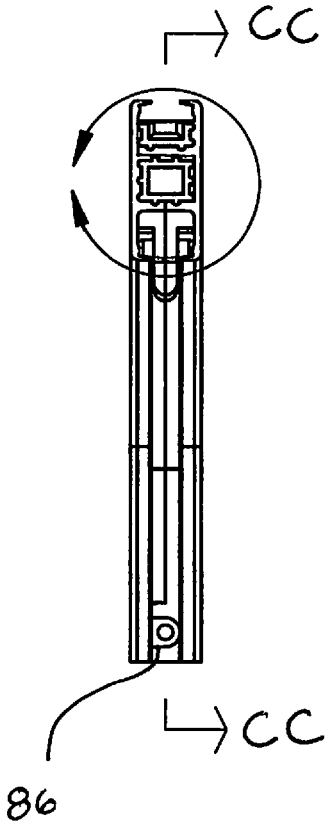
FIG 21
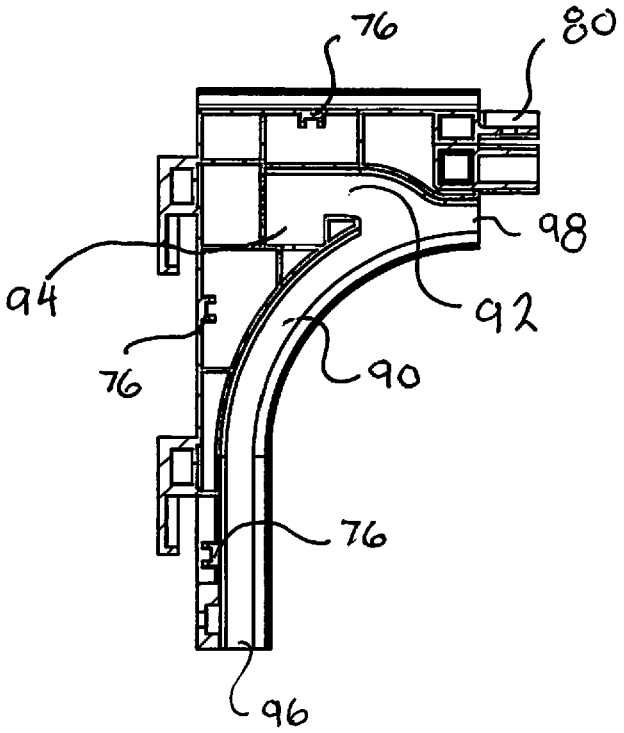
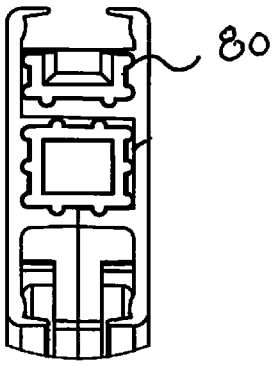
FIG 22

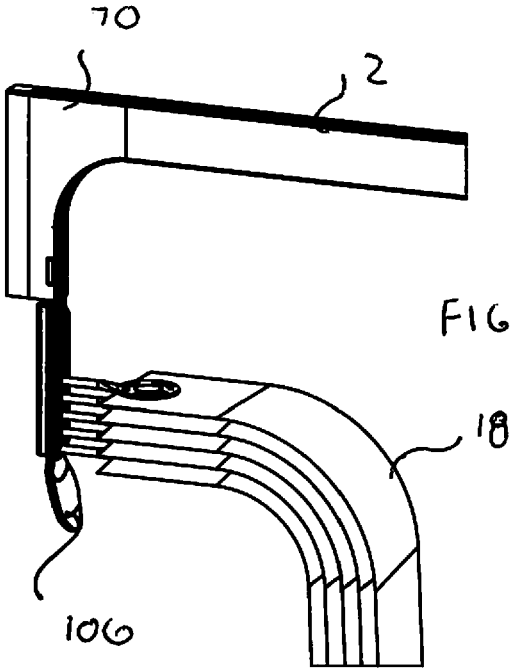
FIG 34
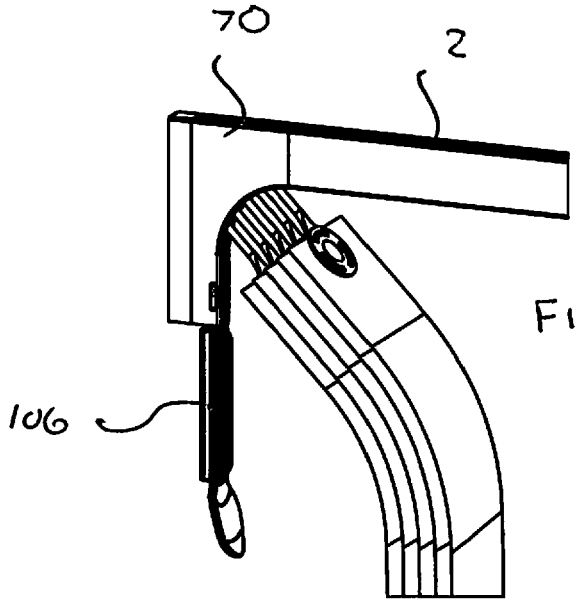
FIG 35
FIG 36
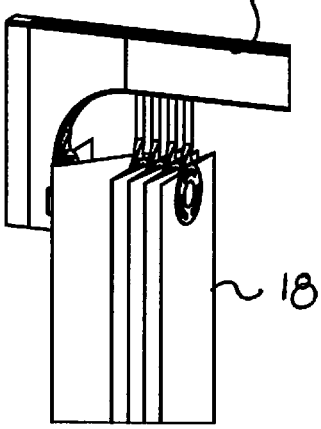

RETROFIT CURTAIN ASSEMBLY

CLAIM FOR DOMESTIC PRIORITY

This application is a continuation of, claims priority to and the benefit of, U.S. Ser. No. 16/001,845 filed Jun. 6, 2018 entitled "RETROFIT CURTAIN ASSEMBLY." The '845 application claims priority from U.S. Provisional Application No. 62/578,762 filed Dec. 4, 2017 entitled "KleenEdge Quick Load Bracket." The '845 application is a continuation-in-part of, claims priority to and the benefit of, U.S. application Ser. No. 15/253,207 filed Aug. 31, 2016 entitled "Cubicle Privacy Curtain Assembly." All of which are incorporated herein in their entirety for all purposes.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to a germ retardant system, and more particularly to a retrofit curtain assembly intended for use in a hospital environment that address all of the current structures and protocol contributing to germ aggregation and transfer from cubicle curtains.

BACKGROUND

Hospitals are notorious for getting sick people sicker. This is understandable as they are filled with a plethora of germs. The frequent touching and sometimes hasty grabbing by medical personnel and patients leads to the outer surfaces of such articles as partition curtains, washroom handrails/grab bars, patient bed bedrails, IV pumps, wheelchair arms, transit beds/undercarriage, stretcher undercarriages/handles, crash carts, and pole stands, dirty and infected with germs. These eventually become breeding grounds for a haven for substances potentially causing medical problems for a patient. For example, a doctor or nurse may have blood, medical waste, or other unclean substances on his or her gloves as contact is made with any of the above. Often the most touched surfaces of a patient's room are rarely cleaned or disinfected.

The Center for Disease Control receives roughly 1.7 million reports of Healthcare Associated Infections (HAI), which annually are attributed to over 99,000 deaths in the USA. Partition curtains are one of the most frequently touched objects in a patient room, are rated the sixth highest high risk touchpoint, and they are considered a key transmission point for cross contamination. They are typically infected with VRE [43%], CDIFF [4%] and MRSA [22%] after just 4 weeks after installation.

Partition curtains are often not cleaned or changed with optimal frequency. Much of the problem lies in the design of the entire curtain assembly from the curtain's size and fabric to the method and height of hanging. Additionally, most hospitals lack viable protocols for the systematic exchange and cleaning of cubicle curtains. This, in part, is due to the intensive labor to replace a complete curtain assembly due to design flaws.

Most American hospitals mount their cubical curtain tracks to the ceilings of the room. Since these are commercial buildings, the ceilings exceed 8 feet and thus the curtain panels are high, heavy and unable to be installed without ladders. The unmanageability of these large, non-standardized curtain panels, the height at which they are hung, the lack of documentation regarding prior curtain replacements, and the need to quickly turn over patient rooms leads to neglected curtain replacements. As a result, often curtains are cleaned only once or twice per year, and by this time the accumulation of infectious material may result in the entire curtain assembly needing replacement.

Henceforth, a system to address germ aggregation on cubical curtains would fulfill a long felt need in the medical industry. This new invention utilizes and combines known and new technologies in a unique configuration to overcome the aforementioned problems and accomplish this.

BRIEF SUMMARY

In accordance with various embodiments, an economical system for preventing the buildup of germs on hospital privacy curtains is provided.

In one aspect, a simplified system for the inexpensive replacement of a hospital privacy curtain utilizing an easy load track bracket, a smaller, disposable lightweight curtain, a quick load curtain installation tool, a lower hang height retrofit rail, a sanitary leading edge panel and replacement protocol alert system is provided.

In another aspect, a universal track bracket and mounting rod for supporting a commercially available curtain hanging track that is adaptable to numerous conventional hanging anchors.

In another aspect, a replaceable polymer panel attachable about the leading edge of a curtain panel or a piece of hospital equipment, that provides a visual indication of where to pull the curtain/touch the equipment as well as when to change it, is provided.

In yet another aspect, a replaceable polymer panel made of a germ retardant material attachable about the leading edge of a curtain panel or about the outer surface of a piece of hospital equipment, that has a visual replacement indicating strip affixed thereto is provided.

A wall mountable microprocessor with a RFID tag (chip) having wireless communication capabilities that signals a computing system for the identification of it's location through a relational database in the computing device so as to generate replacement alerts and also add to the historical data.

A software application capable of establishing a computer system for protocol tracking of any article of hospital related equipment having a germ retardant panel thereon, and sending change alerts to local or remote visual displays, to other computing or "smart" devices.

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components.

FIG. 17 is a side view of a curtain clasp ring;

FIG. 18 is a side perspective view of a curtain clasp ring;

FIG. 20 is an end view of a vertical load hanger bracket;

FIG. 21 is a side cross sectional view of a vertical load hanger bracket;

FIG. 22 is an end view of a quick load hanger bracket;

FIG. 34 is a side perspective view of the first stage of a curtain installation onto a rail with the quick load tool;

FIG. 35 is a side perspective view of the second stage of a curtain installation onto a rail with the quick load tool; and FIG. 36 is a side perspective view of the third stage of a curtain installation onto a rail with the quick load tool.

DETAILED DESCRIPTION OF CERTAIN EMBODIMENTS

Figure 1:
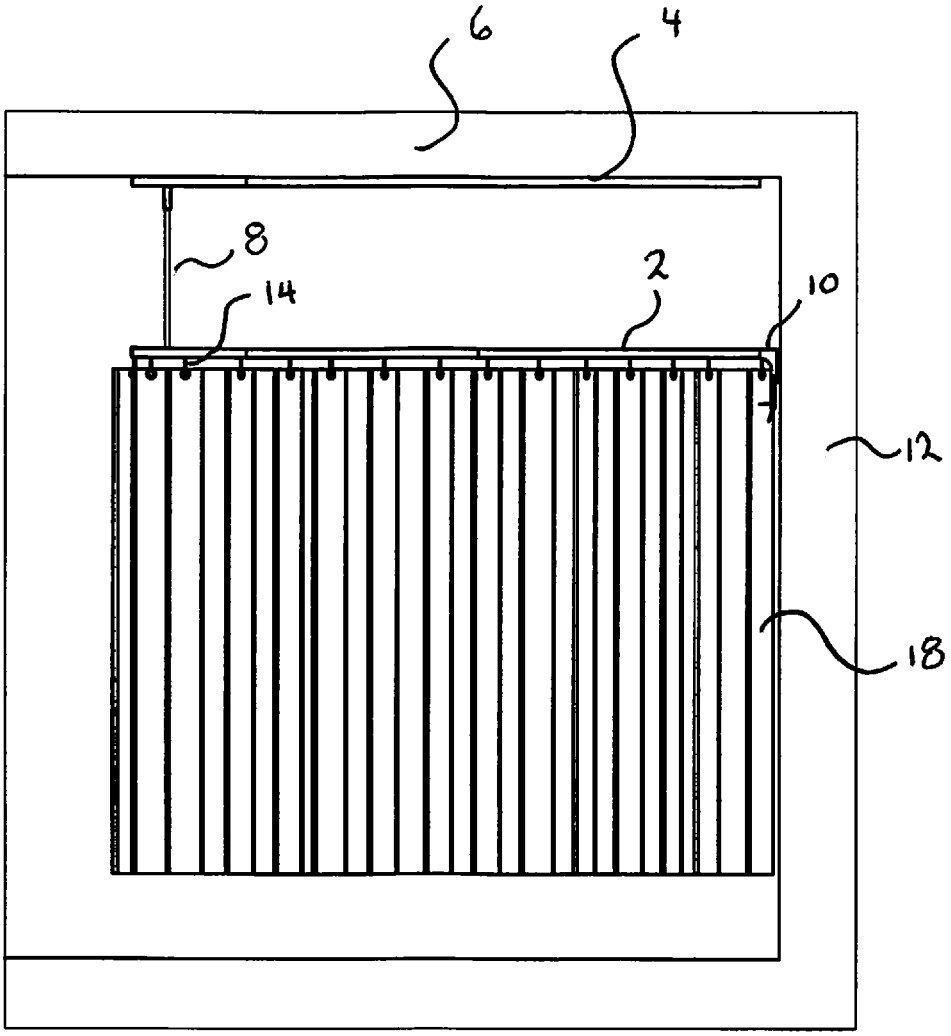
FIG. 1 is a side view of the curtain assembly.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

Conventional current American hospital cubical curtain assemblies utilize a curtain rail that is mounted directly to the room's ceiling and a series of washable cloth curtain panels slideably mounted thereon, and sized for the height and width of that specific room. Since the rooms are generally tall, these cloth fabric curtains are long and heavy, and their hanging access points are high. The leading edge of a medical divider curtain is the most touched item in a patient's room yet is rarely cleaned. Curtain cleaning/replacement requires two people and a ladder to replace a curtain. Once replaced, these curtains are laundered, often without complete eradication of VRE, CDIFF or MRSA contamination.

The present invention is a simplified retrofit assembly for institutional (generally medical/hospital) curtain assemblies. It allows for the inexpensive replacement of an existing curtain assembly with a quick-change disposable curtain assembly that reduces the time, manpower and effort in a curtain change out. It utilizes a height adjustable hanger compatible with conventional curtain tracks, a conventional curtain hanger rail, a quick load vertical hanger bracket; an end bracket, a series of curtain clasps, a smaller, disposable lightweight curtain, and a quick load curtain installation tool. This system, by simplifying curtain replacement, and in conjunction with a sanitary leading edge curtain panel and a replacement protocol alert system will ensure curtains are changed more frequently, therein reducing the spread of germs. Although discussed in a retrofit application herein, it is known that the height adjustable hanger may be mounted to any stationary point above the curtain hanger rail including existing curtain system and a room ceiling.

Some of the more novel aspects of this retrofit curtain assembly are the ease of standardized curtain panel unloading and loading, the low operational height, the use of smaller and lighter curtains, the lower point of track entry for the curtain, the lock in ability for the last curtain clasp and most importantly, the vertical curtain loading accomplished through the vertical load hanger bracket.

Figure 8:
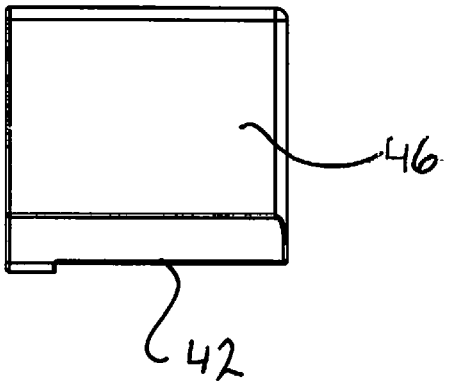
FIG. 8 is a side view of a track end cap.
Figure 7:
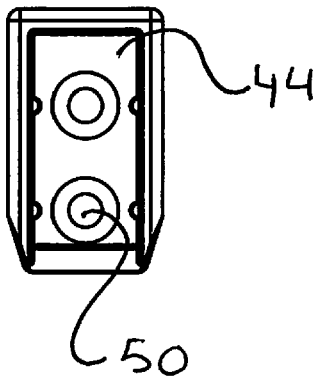
FIG. 7 is an end view of a track end cap.
Figure 6:
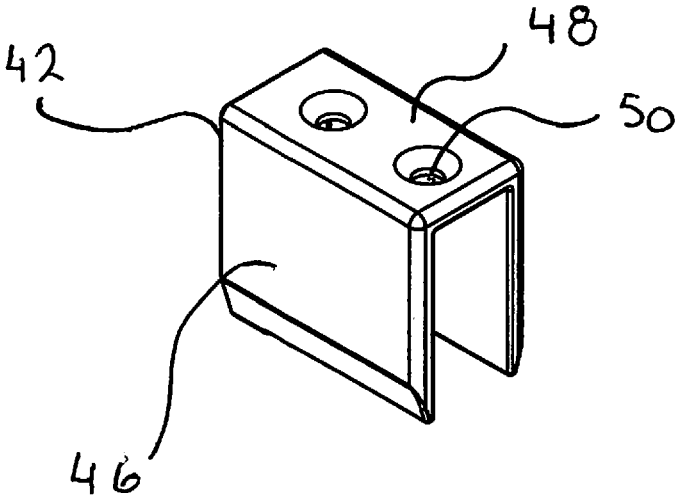
FIG. 6 is a top perspective view of an track end cap.
Figure 9:
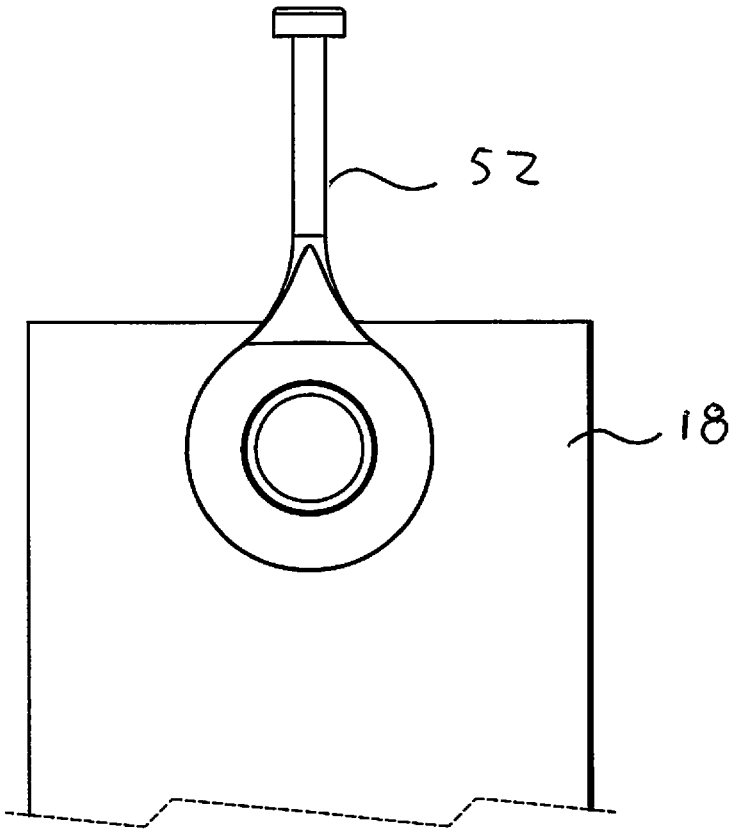
FIG. 9 is a front view of a curtain clasp on a curtain.
Figure 11:
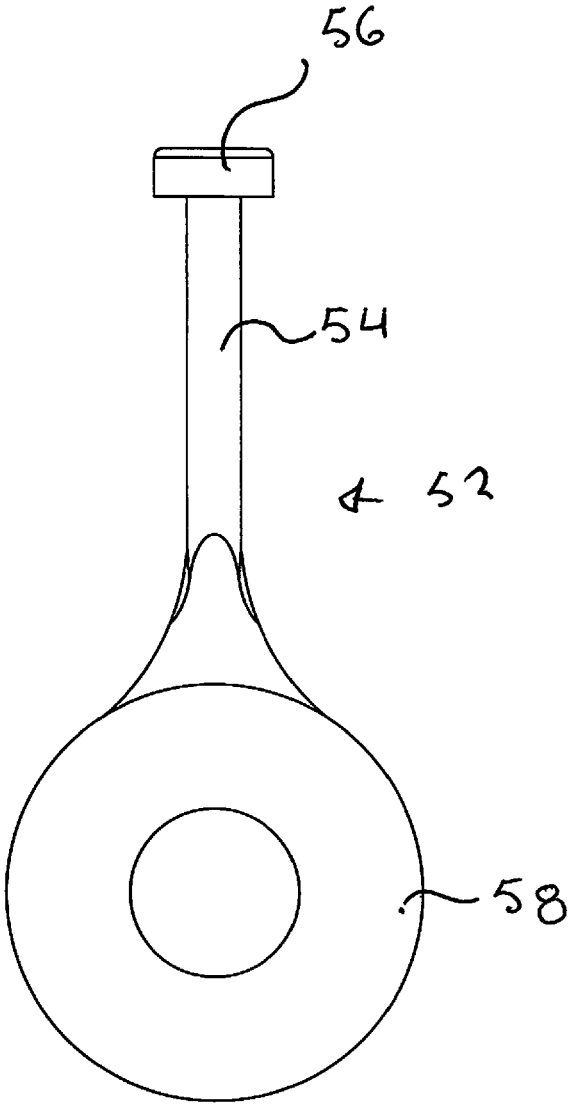
FIG. 11 is a side view of a curtain clasp.
Figure 10:
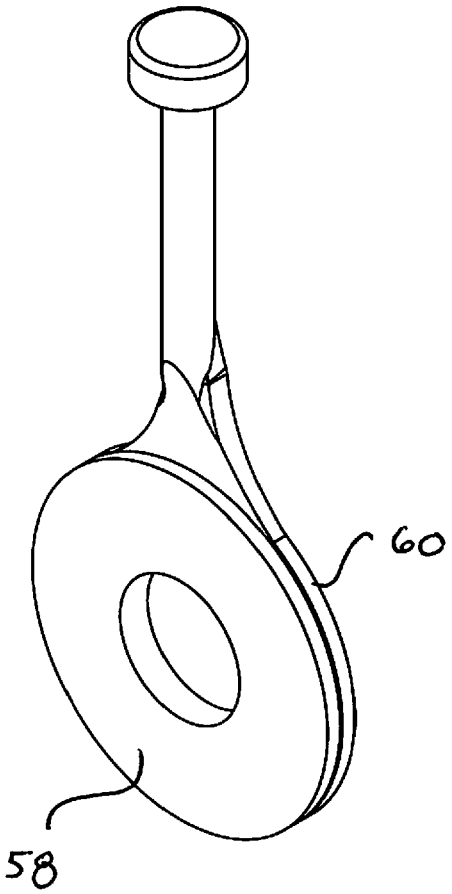
FIG. 10 is a side perspective view of a curtain clasp.

The overall retrofit curtain assembly (FIG. 1) can be seen to encompass a track 2 suspended from an earlier curtain assembly's ceiling track 4 on a room ceiling 6 by a length adjustable track hanger assembly 8. One end of the track 2 is affixed to a wall anchor (anchored to a wall 12 with mechanical fasteners) by a vertical load hanger bracket 10. The other end of the track 2 is directly affixed to a wall by a track end cap (FIGS. 6-8) that is solidly affixed to the room wall with mechanical fasteners. Into the lower channel of the track 2, is slidingly mounted a series of curtain clasps 14 which are sandwiched onto the curtain 18, in an equally spaced configuration, along and adjacent the curtain's top perimeter edge.

Figure 3:
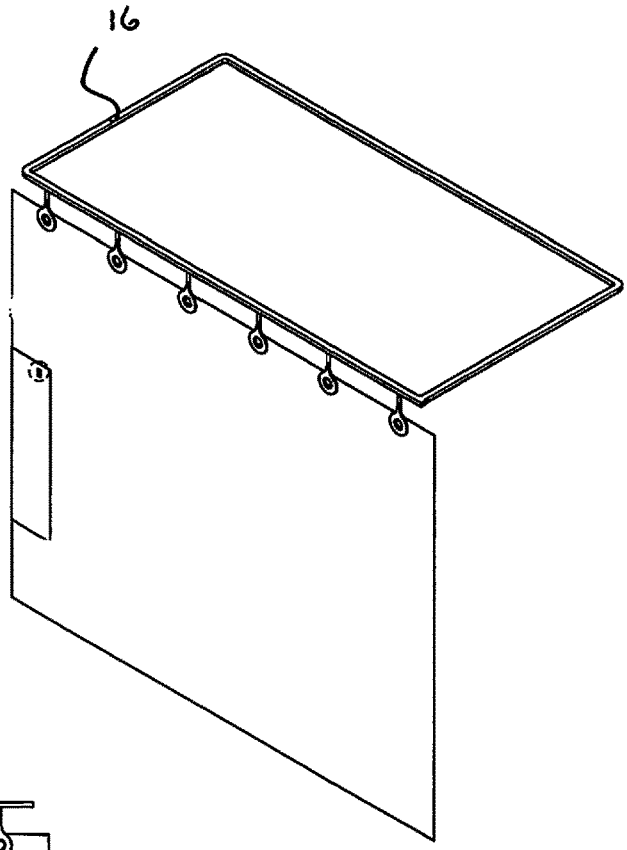
FIG. 3 is a top perspective view of a prior art curtain assembly.
Figure 2:
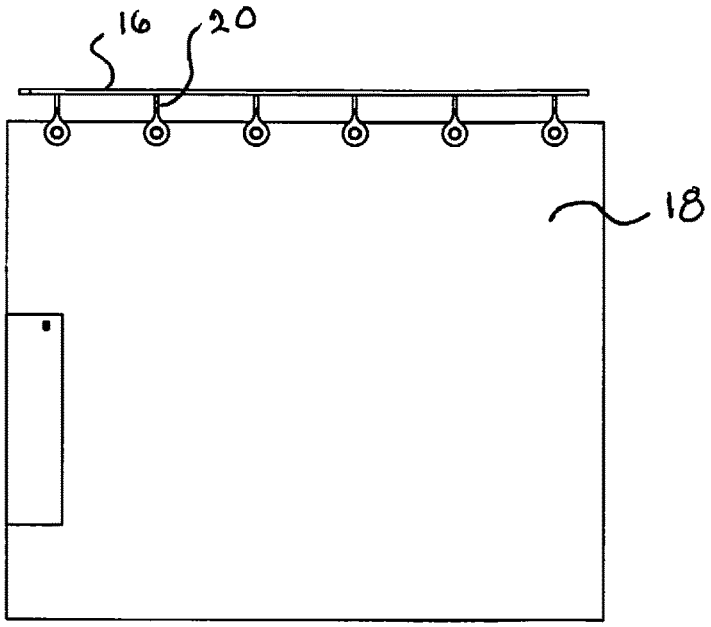
FIG. 2 is a side view of a prior art curtain assembly.

A prior art conventional curtain assembly can be seen in FIGS. 2 and 3. It uses a direct mount ceiling track 16 that is secured to the ceiling by mechanical fasteners that thread into the ceiling with their heads constrained in the longitudinal channel in the ceiling track 16. The upper sliding ends of the curtain hangers 20 are trapped in the ceiling track 16. Hooks on the lower ends of the curtain hangers 20 pass through eyelets along the top edge of the curtain 18. Since hospital privacy curtains have a lower edge generally maintained at a fixed distance above the floor (approximately 12 inches), each set of curtains has to be made to a custom length to fit the ceiling height of the room. These make for tall curtains 18 that are heavy and must be changed on each individual curtain hanger 20 by two people with a ladder. This is a time and manpower consuming feat with the inherent potential for falling off the ladder. All curtains are loaded horizontally.

Figure 5:
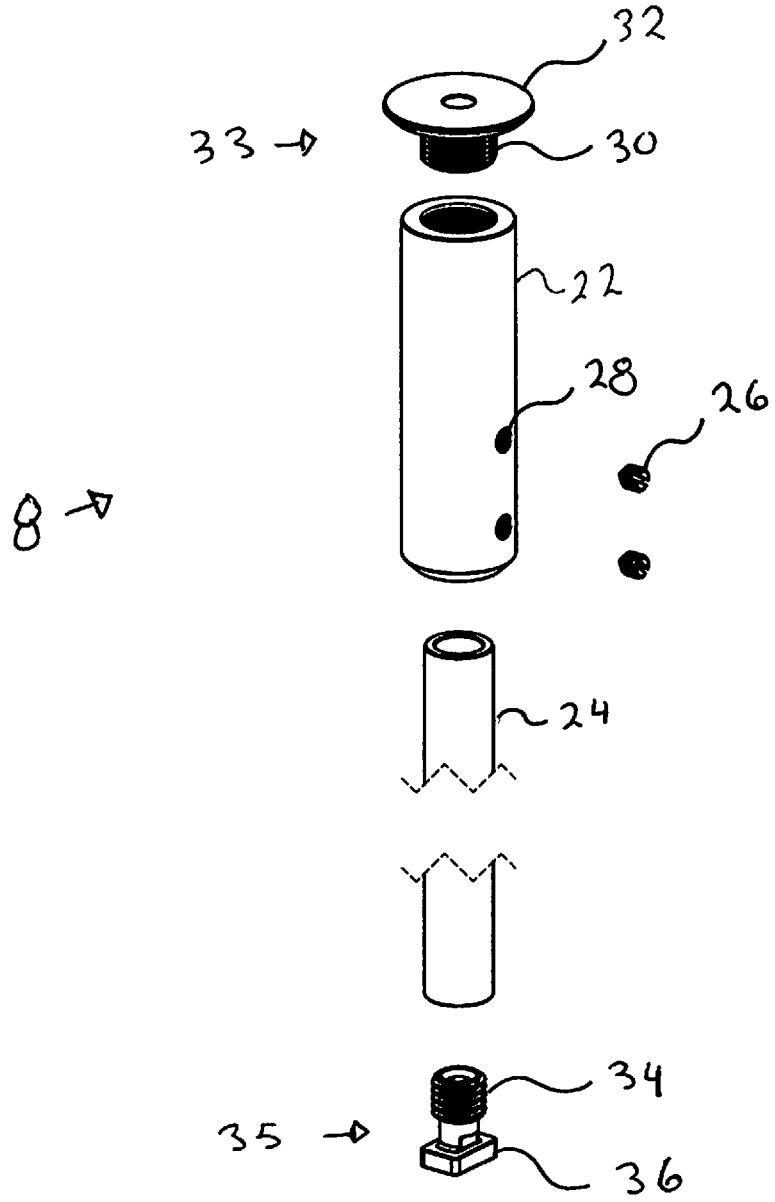
FIG. 5 is an exploded view of a track hanger assembly.

The retrofit assembly lowers the vertical hang height of the top of the curtain 18 utilizing a series of track hanger assemblies 8 (FIGS. 1 and 5) that suspend the track 2 for all applications, at a fixed distance from the floor, directly from the ceiling track 16 of the previous curtain assembly. The track hanger assembly 8 is a set of nestled concentric cylinders slidingly and frictionally engaged about their respective inner and outer diameters. In the preferred embodiment it has a first diameter, outer, upper cylinder 22 that houses a second, smaller diameter inner, lower cylinder 24 that is extended from the outer cylinder's bottom end to the desired length and locked into place by at least one locking fastener 26 that threadingly extends axially through a threaded bore 28 through the side wall of the outer cylinder 22. The preferred embodiment locking fastener 26 is commonly referred to as a set screw or grub screw, and has a conical formation on one end.

In curtain systems that do not have ceiling mounted rails, or in new room applications (generally with suspended ceilings) the first diameter, outer, upper cylinder is affixed to either the ceiling with a modified plug that threadingly engages an imbedded anchor or threads into a planar substrate such as a piece of plywood that resides on the upper edge of the suspended ceiling rails.

The top end of the outer cylinder 22 is internally threaded to matingly conform with the external threads 30 on the upper flanged plug 33. In a similar fashion the bottom end of the inner cylinder 24 is internally threaded to matingly conform with the external threads 34 on the lower flanged plug 35. Each of the flanged plugs have generally planar top and bottom flanges 32 and 36 at their ends with larger diameters than their respective plugs's threaded bodies.

During the retrofit installation the top flange 32 is inserted into the existing ceiling track and the upper flanged plug 33 is threaded into the upper cylinder 22. The lower cylinder 24 is extended from the bottom end of the upper cylinder 22 to the desired height for the retrofit track 2 and the locking fasteners 26 threaded into threaded bores 28 through the side wall of the outer cylinder 22 to contact, indent and lock the inner cylinder vertically in place. The bottom flange 36 is inserted into the top channel 38 of the track 2 (FIG. 4) and the bottom flanged plug 35 is threaded into the bottom end of the lower cylinder 24. In this way, the track hanger assembly 8 supports the track 2 from the ceiling rail 4.

It is known that there is a plethora of equivalent track hanger assemblies that may be substituted. The length adjustable feature is used only for the initial installation and as such, single piece track hangers could be cut to length on site and used. The novelty of the preferred embodiment being that it requires no tools other than a screwdriver to adjust to length and install.

Figure 4:
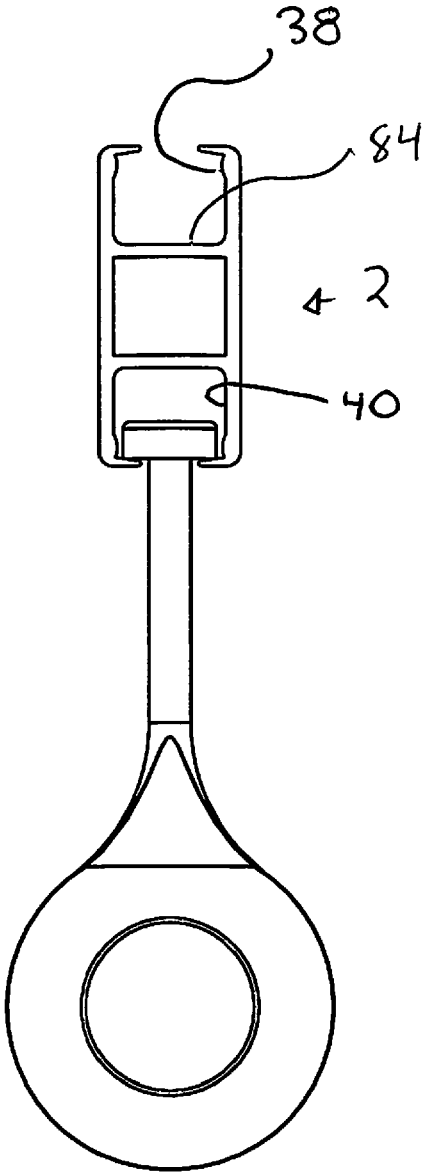
FIG. 4 is an end view of a curtain hook installed on a rail.
Figure 19:
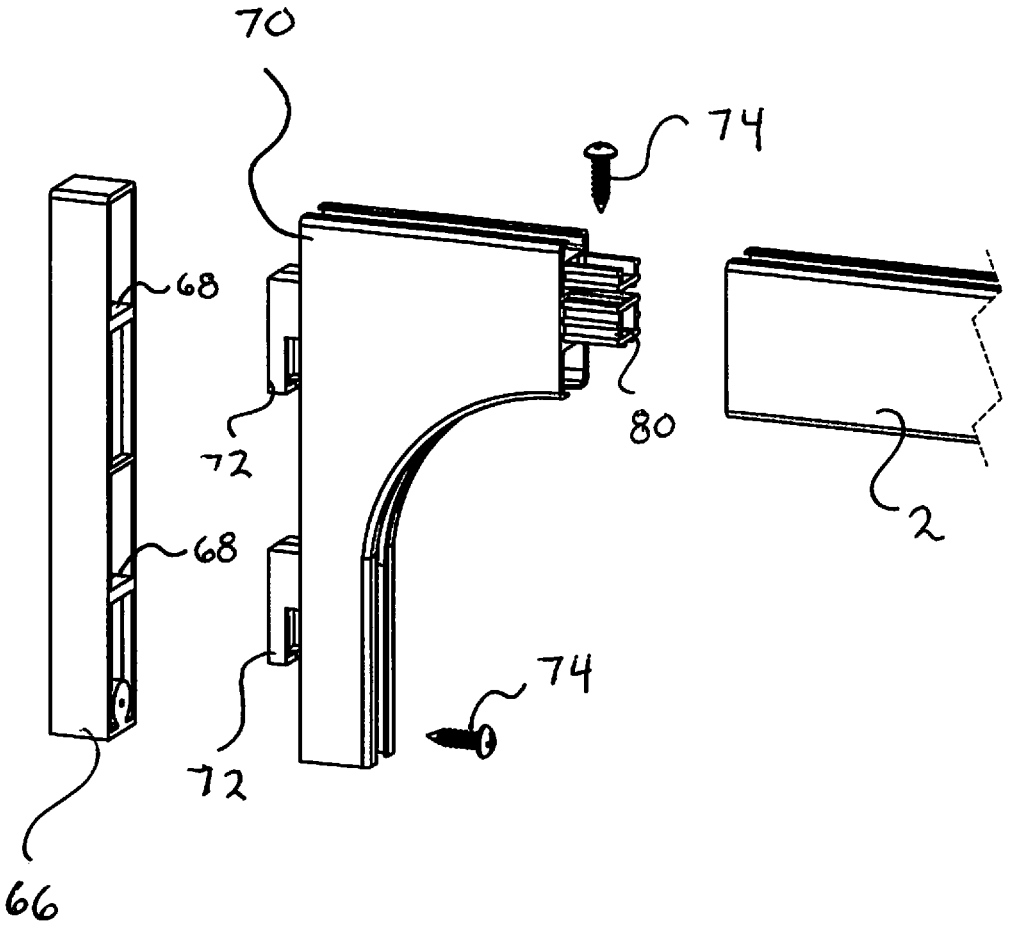
FIG. 19 is a side perspective view of an exploded vertical load hanger bracket end of a curtain assembly and the first embodiment wall anchor.
Figure 29:
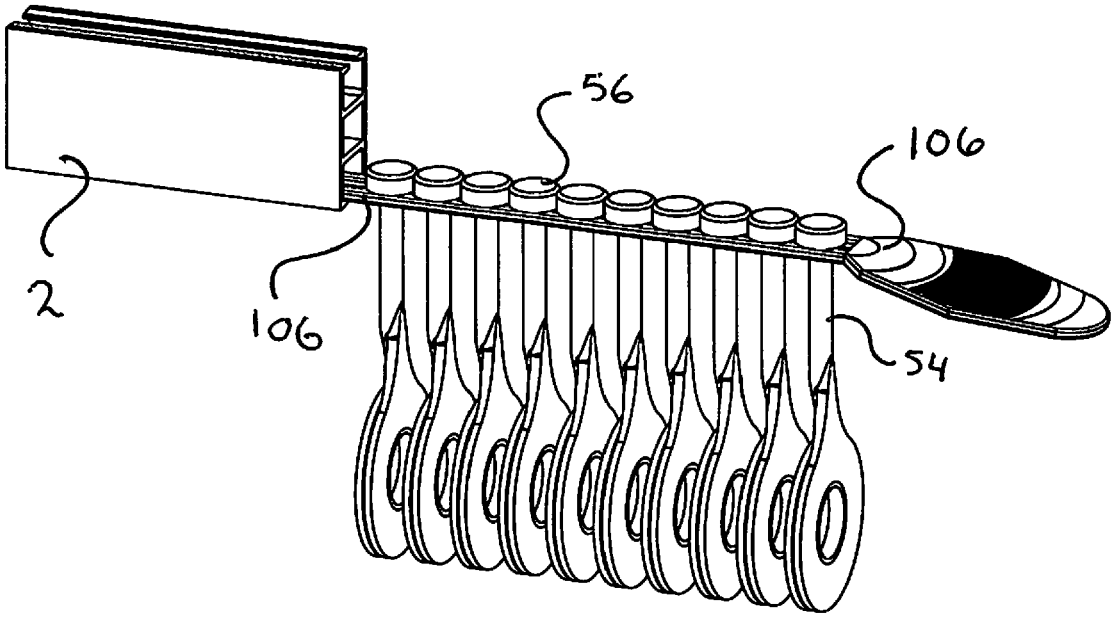
FIG. 29 is a side perspective view of the quick load tool inserted into a rail.

The track 2 is best seen in FIGS. 4, 19 and 29. It is a commercially available aluminum extruded linear rail with two parallel channels. The track 2 is symmetrical about its linear axis, however this need not be the case for all embodiments. The critical feature is that the track 2 have an upper channel 38 sized for retention of the bottom flange 36, that is separated from a lower channel 40 sized for the sliding retention of the curtain clasp 14. In the preferred embodiment the track 2 has a central channel that separates the U shaped upper channel 38 and the U shaped lower channel 40. This central channel is instrumental in connecting the vertical load hanger bracket 70 to the track 2.

A track end cap 42 (FIGS. 6-8) is a wall bracket mechanically fastened to one room wall and is used to secure one end of the track 2. It has generally open cuboid geometrical configuration with two parallel side walls each connected by two perpendicular but not parallel walls that share a common edge and reside perpendicular to each other. Stated otherwise the track end cap 42 is a C shaped member with one common end wall 44 that shares one edge with each of the other walls, where all walls are rectangular. The C shape is defined by two parallel walls 46 joined by a perpendicular intermediary wall 48. There are bores 50 formed through intermediary wall 48 and the end wall 44. For connection, mechanical fasteners are passed through the end wall 44 into the room wall such that the intermediary wall resides at the approximate height of the bottom of the track 2. One end of the track 2 is placed in the track end cap 42 and mechanical fasteners are run between the bores 50 in the intermediary wall into the lower channel 40 of the track 2.

Figure 12:
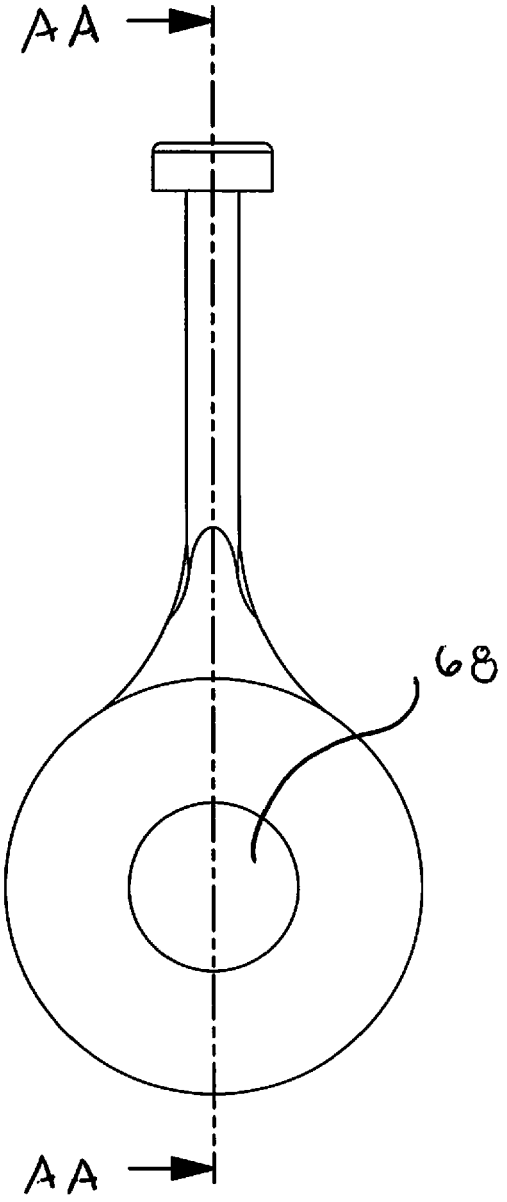
FIG. 12 is a side view of a curtain clasp showing the linear centerline.
Figure 13:
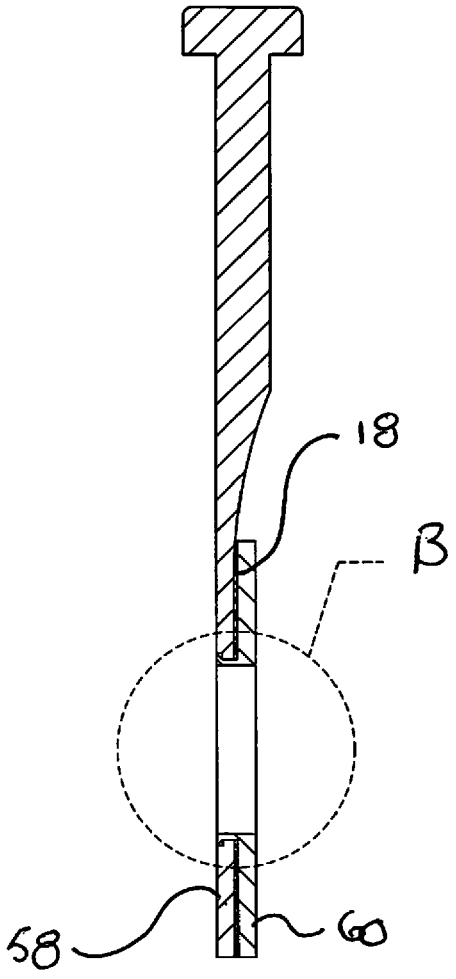
FIG. 13 is a cross sectional view of a curtain clasp through the linear centerline.
Figure 14:
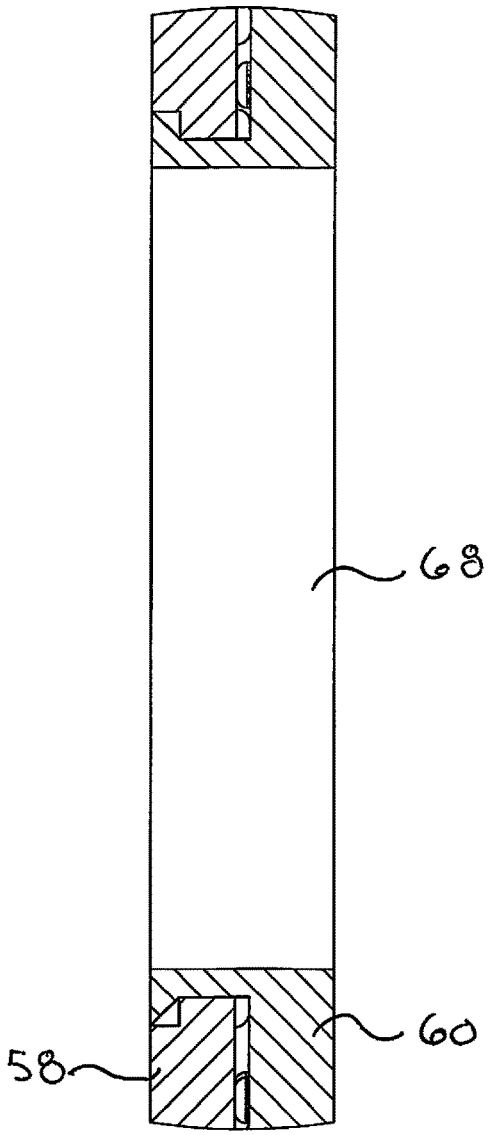
FIG. 14 is an enlarged cross sectional view of a curtain clasp.
Figure 15:
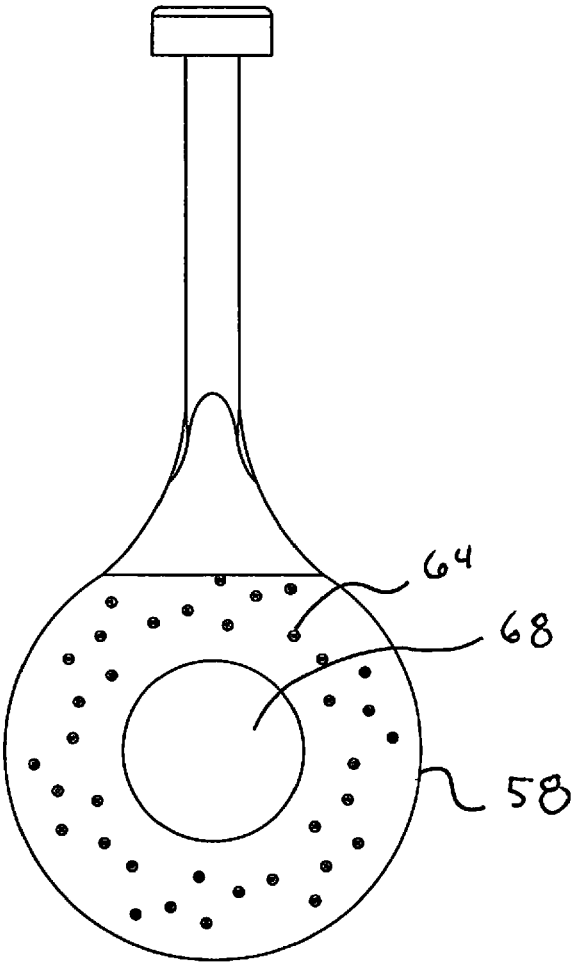
FIG. 15 is a side view of a curtain clasp support ring.
Figure 16:
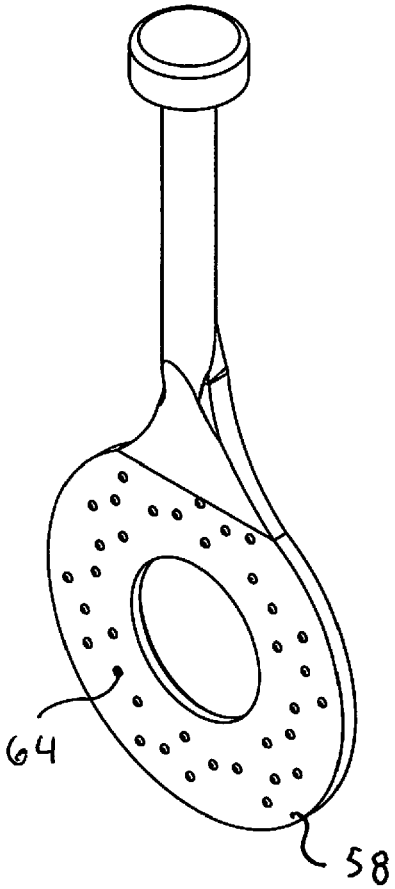
FIG. 16 is a side perspective view of a curtain clasp support ring.

The curtain clasp 52 (FIGS. 9-18) attaches to the curtain 18 and slidingly engages along the lower channel 40 of the track 18 to allow the curtain 18 to be moved along the track 2. It has a two piece construction that sandwiches the fabric of the curtain 18 therein a two part support ring. It is a cylindrical shaft 54 with a track disk 56 affixed at its distal end perpendicularly to the linear axis of the shaft 54 and a first half support ring 58 and a second half support ring 60 at its proximal end. Looking at FIG. 13 illustrating the cross section taken through line AA of FIG. 12, it can be seen that the second half support ring 60 is formed as a separate detached ring. It is to be noted that a track disk 56 may have various physical configurations including a cylindrical plate (the preferred embodiment) a spheroid, a spherical body of geometrical equivalent designed for sliding movement within the track 2.

The support rings each have central orifices 68 and complimentary electron welding nubs 64 formed on their inner faces. The second half support ring 60 has an internal ledge 62 sized for engagement about the periphery of the central orifice in the first half support ring. Looking at the enlarged image of section B of FIG. 13 it can be seen that the curtain 18 is sandwiched between the first half support ring 58 and the second half support ring 60 and the two support rings are welded together.

The curtain 18 (FIGS. 1, 9 and 27) is a polymer sheet with a series of equally spaced orifices formed adjacent its top edge that allows the passage of the internal ledge 62 there through so that the curtain clasp 52 can be affixed by welding to the curtain 18.

The vertical load hanger bracket 70 and first embodiment wall anchor 66 can best be seen with reference to FIGS. 19-22. The first embodiment wall anchor 66 is a rectangular section with two hook sockets 68 formed therein for mating engagement with the hook arms 72. The two hook sockets 68 reside vertically adjacent each other along the linear centerline of the first embodiment wall anchor 66. Mechanical fasteners connect the inside rear wall of the first embodiment wall anchor 66 to the room wall as is well known in the art.

The vertical load hanger bracket 70 is of a substantially mirror image, two part polymer design engineered in halves with connection via a pair of mechanical fasteners 74 (screws in the preferred embodiment) and three frictionally engageable mating tab/socket arrangements 76 on the interior of the bracket 70. An alignment sleeve 80 extends from the bracket 70 above the vertical opening 96 and is used for mating engagement and alignment with the track 2 by insertion into the track's upper channel 38 and lower channel 40. The alignment sleeve 80 extends above and below the bottom 84 of the upper channel (FIG. 4). A screw recess 86 protrudes from one of the halves of the bracket. The screws 74 are connected between the alignment sleeve 80 and the track 2 and between the screw recess 80 of one of the bracket halves and the opposing half. The screws 74 thus hold the two halves of the bracket 70 together.

Looking at the cross sectional view of the vertical load hanger bracket 70 in FIG. 21 (taken through line CC of FIG. 20) it can be seen that it has an internal, closed path for the sliding movement of track disks 56 having a vertical opening 96 at a first end, and a horizontal opening 98 at a second end. The path has two converging channels formed therein for the track disk 56 of the curtain clasp 52 to travel. The vertical loading channel 90 has a path beginning vertically and arcing 90 degrees so as to end horizontally in the lower channel 40 of the connected track 2. This allows the track disks 56 of the curtain clasp 52 to enter vertically at the bottom of the vertical load hanger bracket 70 and slide into the track's lower channels 40. The second channel is the lock channel 92. This lock channel has a vertical path also in the vertical load hanger bracket 70. This vertical path extends horizontally from where the vertical loading channel 90 and the lock channel 92 meet and share their common horizontal opening 98, and it ends at a closed drop-down pocket 94 that drops below the lock channel's vertical path but above the loading channel's 90 degree arc. It is used to receive and removably constrain a track disk 56 that enters the top, horizontal region of the loading channel 90 at the horizontal opening 98 and follows the vertical path of the lock channel 92.

Figure 26:
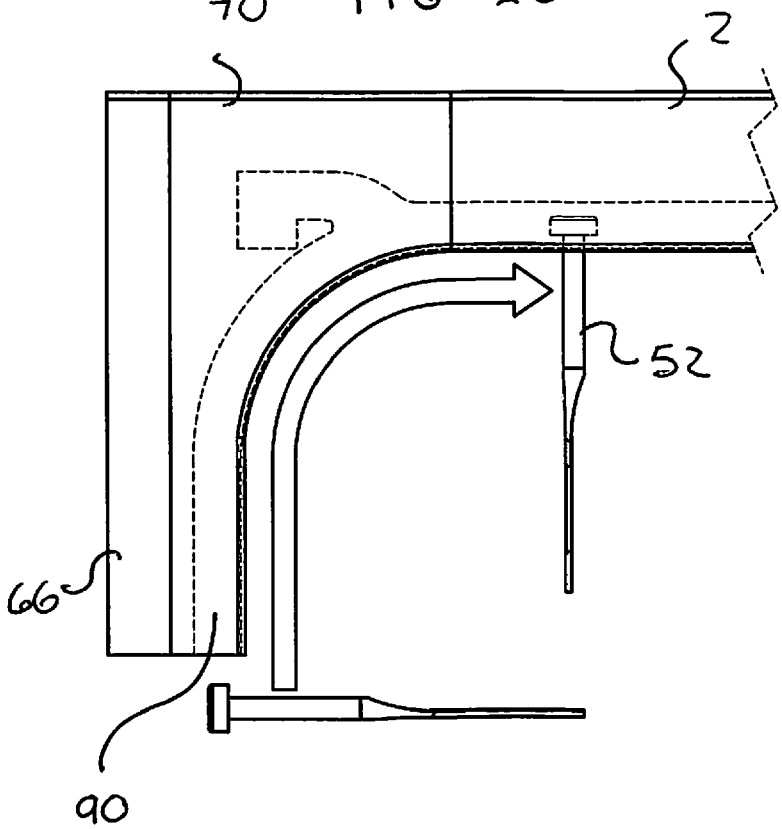
FIG. 26 is a side phantom view of a curtain clasp being loaded into the hanger bracket.
Figure 28:
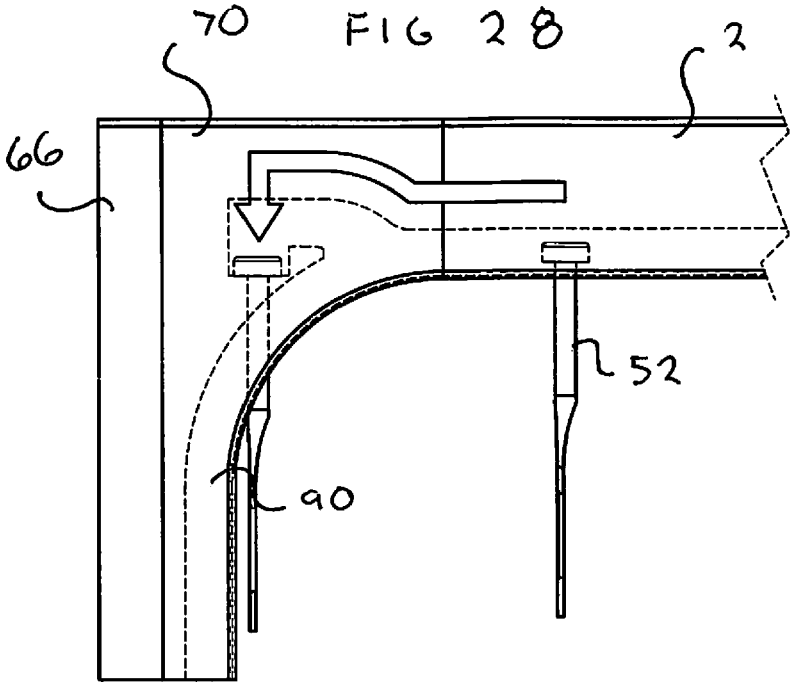
FIG. 28 is a side phantom view of a curtain clasp being locked into the quick load hanger bracket.
Figure 27:
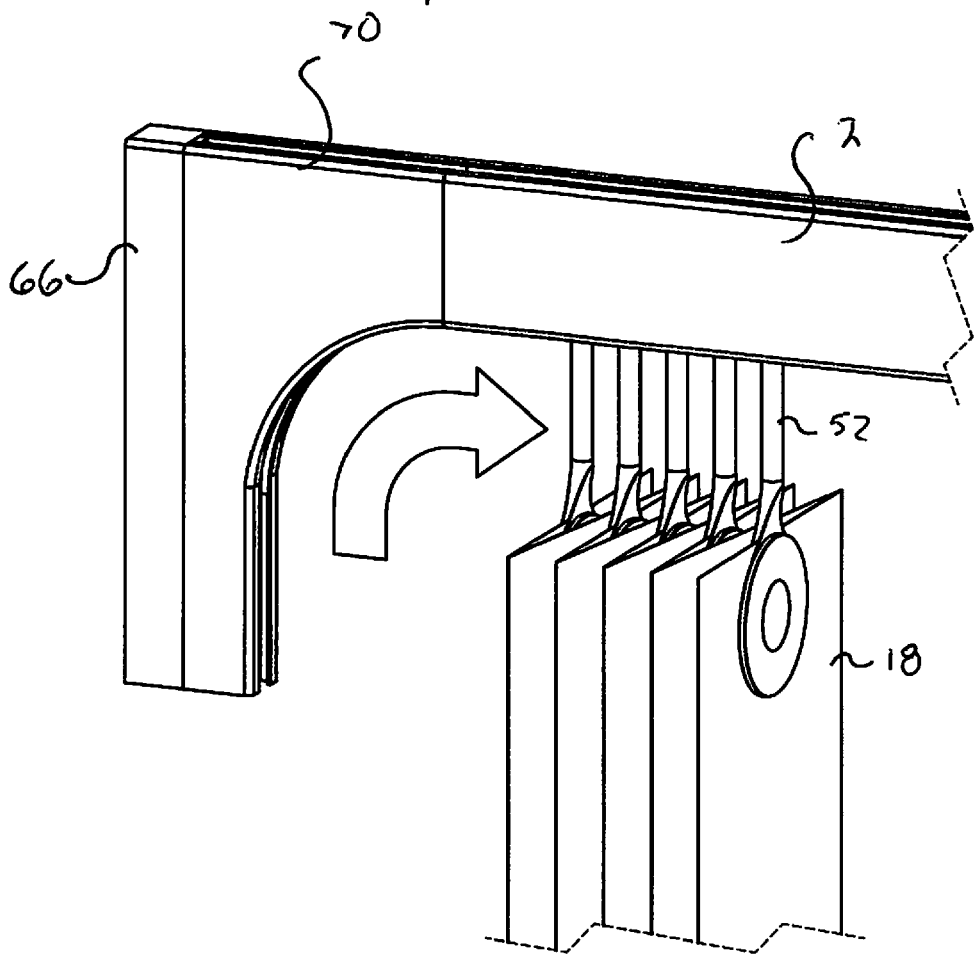
FIG. 27 is a side perspective view of a curtain loaded onto the track.

FIGS. 26 to 28 show the three stages of the curtain clasp 52 installation onto the track 2 and the vertical load hanger bracket 70. In the first stage, all of the track disks 56 of the curtain clasps 52 are inserted vertically into the 90 degree arced loading channel 90 (FIG. 26) and slid into the lower channel 40 of the track 2. (FIG. 27) The last track disk 56 is then slid rearward back toward the vertical load hanger bracket 70 in the lock channel 92 until it drops into the track disk pocket 94, therein preventing the movement of the end of the curtain 18 and locking it into the back of the vertical load bracket 70 adjacent the room wall.

Figure 23:
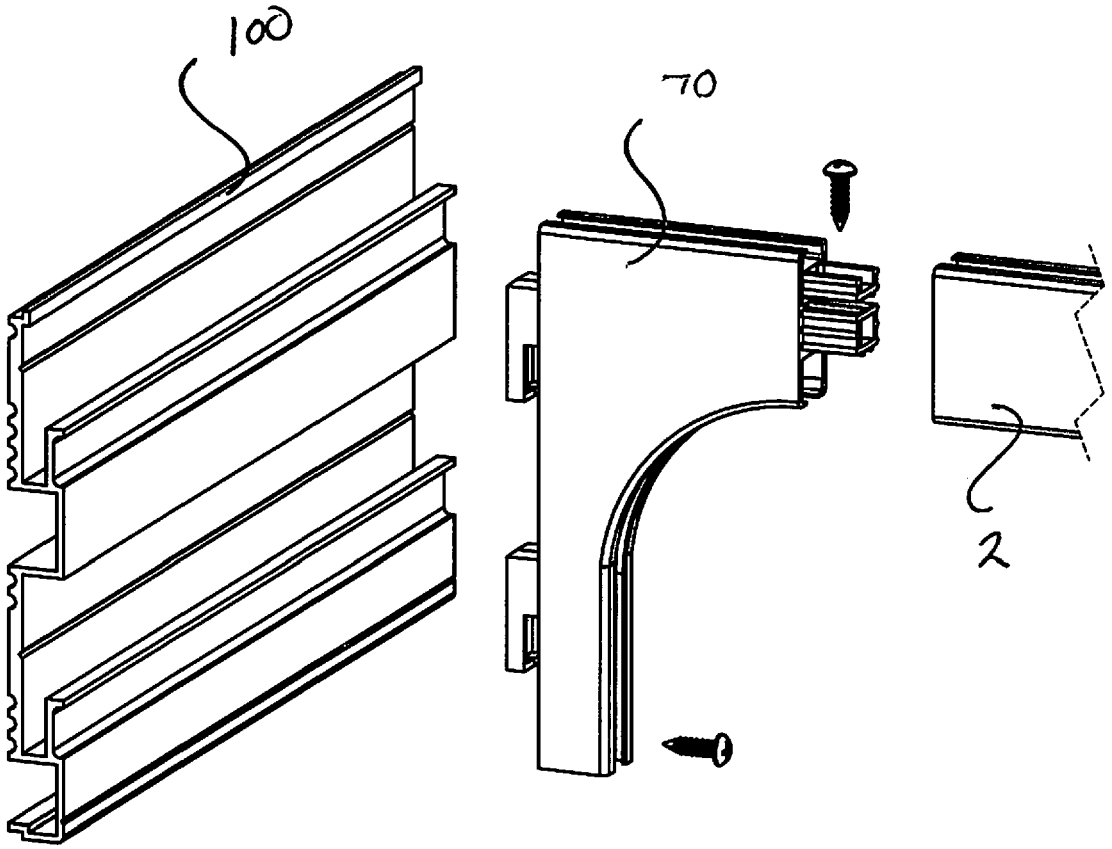
FIG. 23 is a side perspective view of an exploded quick load hanger bracket end of a curtain assembly and the second embodiment wall anchor.
Figure 24:
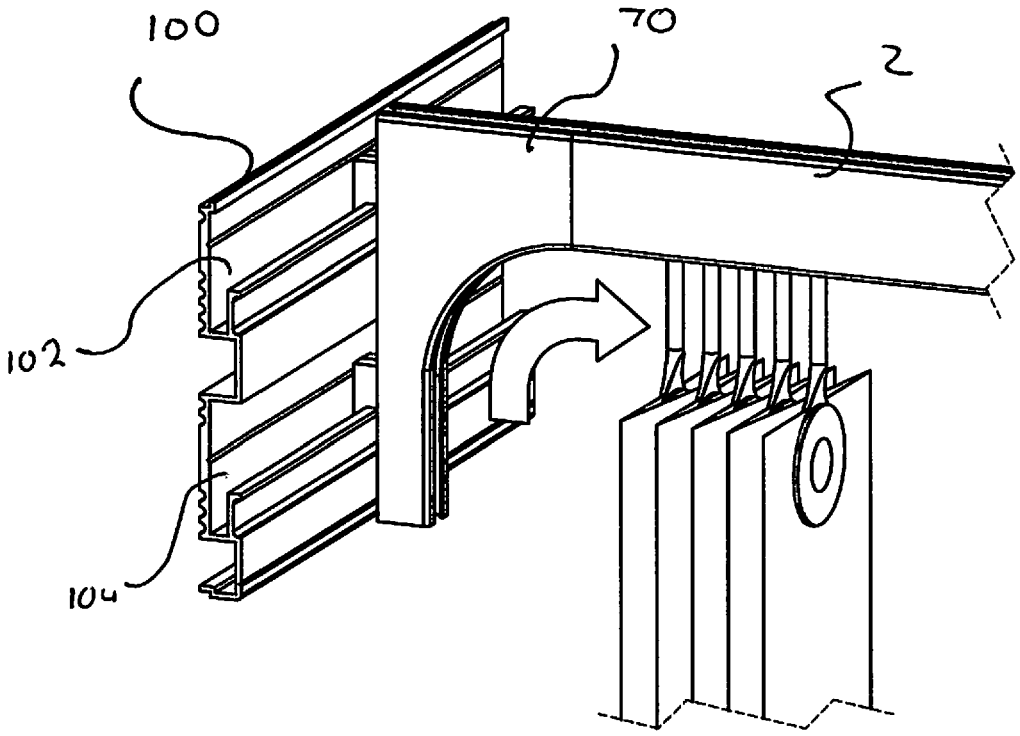
FIG. 24 is a side perspective view of a curtain assembly mounted to the second embodiment wall anchor.
Figure 25:
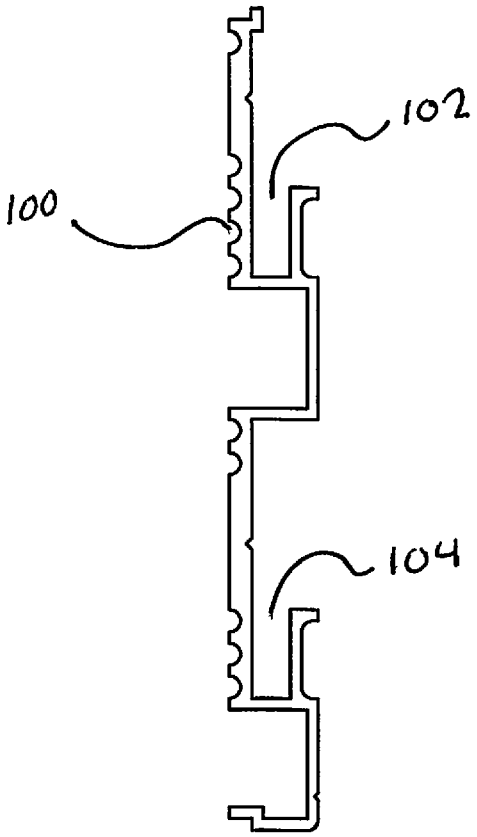
FIG. 25 is a cross sectional view of the second embodiment wall anchor.

The vertical load hanger bracket 70 may also be affixed to the second embodiment wall anchor 100. (FIGS. 23-25) This second embodiment wall anchor 100 is an extruded panel that me be affixed to the room wall by various methods as is well known in the industry. In the preferred embodiment, this would be mechanical anchors such as screws, anchor bolts and the equivalent. The second embodiment wall anchor 100 has an upper hook channel 102 and parallel lower hook channel 104 formed there along for mating engagement with the hook arms 72. This mating engagement serves to hold the vertical load hanger bracket 70 parallel to the room wall.

Figure 30:
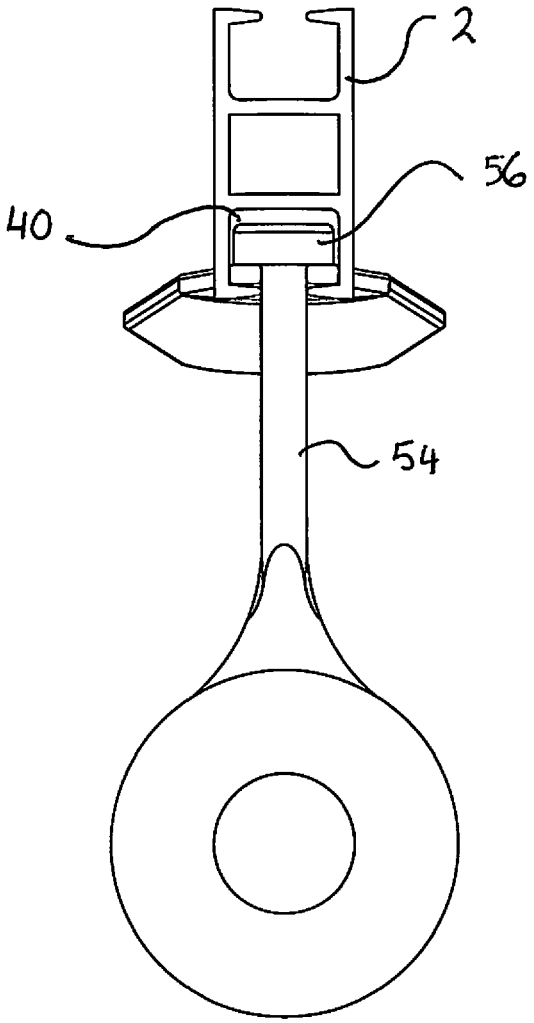
FIG. 30 is an end view of the curtain clasp in the quick load tool.
Figure 33:
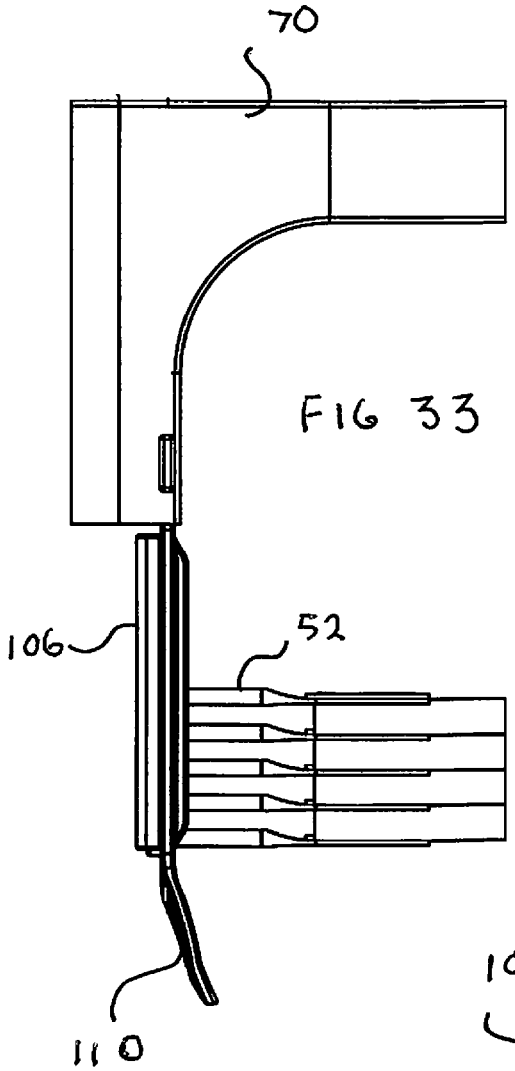
FIG. 33 is a side view of a curtain installation with the quick load tool.
Figure 31:
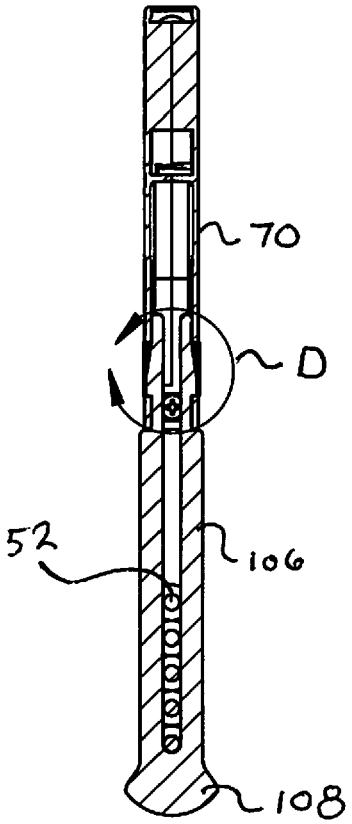
FIG. 31 is a top cross sectional view of the quick load tool inserted into the hanger bracket.
Figure 32:
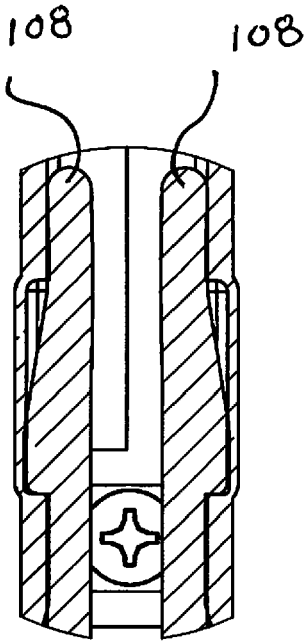
FIG. 32 is an enlarged view of the leading edge of the quick load tool inserted into the hanger bracket.

The quick load tool 106 can best be explained by the illustration of FIG. 29 showing it loading a series of curtain clasps 52 into the lower channel 40 of the track 2. The quick load tool 106 is essentially a generally linear member fork that has a pair of parallel arms 108 with a separation distance sized to accommodate the diameter of the cylindrical shaft 54 of the curtain clasp 52 there between. This is illustrated in FIG. 32 which is an enlargement of section D of FIG. 31 and FIG. 30. The track disks 56 reside on the top side of the parallel arms with the cylindrical shaft 54 passing between the two arms 108 and the first half support ring 58 and a second half support ring 60 hanging below. The two arms 108 converge at a handgrip 110 used to maneuver the tool 106 vertically into the vertical load hanger bracket 70 as is seen in FIG. 30 and FIG. 33. In operation, the two arms 108 are inserted into the loading channel 90 such that their bottom face contacts the loading channel and the track disks 56 can be slid out into the loading channel 90, the track lower channel 40, the lock channel 92 and the track disk pocket 94. The three step operation of hanging of a curtain 18 onto a track 2 with the quick load tool 106 and locking the back edge of the curtain 18 to the bracket 70 is illustrated sequentially in FIGS. 34 to 36.

While certain features and aspects have been described with respect to exemplary embodiments, one skilled in the art will recognize that numerous modifications are possible. Further, while certain functionality is ascribed to certain system components, unless the context dictates otherwise, this functionality can be distributed among various other system components in accordance with the several embodiments. In the way of an example, it is known that this curtain assembly's track hanger assembly may be mounted directly to a room ceiling by mechanical attachment of the upper flanged plug 33 or a functional equivalent to the ceiling, without the attachment to an existing curtain assembly's ceiling track.

Moreover, while various embodiments are described with—or without—certain features for ease of description and to illustrate exemplary aspects of those embodiments, the various components and/or features described herein with respect to a particular embodiment can be substituted, added, and/or subtracted from among other described embodiments, unless the context dictates otherwise. Consequently, although several exemplary embodiments are described above, it will be appreciated that the invention is intended to cover all modifications and equivalents within the scope of the following claims.

The invention claimed is:

1. A bracket comprising:

a first channel configured to receive a plurality of hanger arms; and a second channel branching from and converging with the first channel, wherein the second channel is configured to receive one hanger arm of the plurality of hanger arms after the one hanger arm traverses at least a portion of the first channel, wherein the second channel comprises a pocket, wherein a bottom surface of the pocket resides below a bottom surface of the second channel, and wherein the pocket is configured to restrict the one hanger arm from exiting the second channel and entering the first channel, after the one hanger arm enters the second channel from the first channel.

2. The bracket of claim 1, wherein the plurality of hanger arms comprises a plurality of curtain hanger arms configured to hold one or more curtains.

3. The bracket of claim 1, wherein the pocket resides above an entry point of the first channel.

4. The bracket of claim 1, wherein the pocket removably contrains the one hanger arm from translating within the second channel towards the first channel.

5. The bracket of claim 1, wherein the one hanger arm is configured to at least one of enter or exit the pocket.

6. The bracket of claim 1, wherein the one hanger arm is configured to be removed from the second channel.

7. The bracket of claim 1, wherein the second channel terminates at the pocket.

8. The bracket of claim 1, wherein the first channel comprises a 90 degree arced loading channel.

9. The bracket of claim 1, wherein the first channel comprises a vertical opening.

10. The bracket of claim 1, wherein the first channel comprises a vertical opening and a horizontal opening therefrom.

11. The bracket of claim 1, wherein the one hanger arm includes the last hanger arm to enter the bracket among the plurality of hanger arms.

12. The bracket of claim 1, wherein the second channel is above a vertical opening of the first channel.

13. The bracket of claim 1, wherein the one hanger arm is an end hanger arm of the plurality of hanger arms.

14. The bracket of claim 1, further comprising an attachment component that is configured to attach the bracket to at least one of a wall or a ceiling.

15. The bracket of claim 1, wherein the first channel interfaces with a track such that the plurality of hanger arms are configured to translate out of the first channel and into the track.

16. The bracket of claim 1, wherein the first channel interfaces with a horizontal channel.

17. The bracket of claim 1, wherein the second channel removably restricts the one hanger arm from entering the first channel.

* * * * *